US010100383B2

(12) United States Patent
Hanamura et al.

(10) Patent No.: US 10,100,383 B2
(45) Date of Patent: Oct. 16, 2018

(54) MARTENSITIC STEEL AND METHOD FOR PRODUCING SAME

(71) Applicant: NATIONAL INSTITUTE FOR MATERIALS SCIENCE, Ibaraki (JP)

(72) Inventors: Toshihiro Hanamura, Ibaraki (JP); Shiro Torizuka, Ibaraki (JP)

(73) Assignee: NATIONAL INSTITUTE FOR MATERIALS SCIENCE, Ibaraki (JP)

( * ) Notice: Subject to any disclaimer, the term of this patent is extended or adjusted under 35 U.S.C. 154(b) by 398 days.

(21) Appl. No.: 14/901,782

(22) PCT Filed: Jul. 9, 2014

(86) PCT No.: PCT/JP2014/068313
§ 371 (c)(1),
(2) Date: Dec. 29, 2015

(87) PCT Pub. No.: WO2015/005386
PCT Pub. Date: Jan. 15, 2015

(65) Prior Publication Data

US 2016/0369365 A1 Dec. 22, 2016

(30) Foreign Application Priority Data

Jul. 9, 2013 (JP) ..... 2013-143920

(51) Int. Cl.
*C21D 9/00* (2006.01)
*C21D 8/02* (2006.01)
(Continued)

(52) U.S. Cl.
CPC ..... *C21D 9/0081* (2013.01); *B21J 5/00* (2013.01); *C21D 6/005* (2013.01); *C21D 7/13* (2013.01);
(Continued)

(58) Field of Classification Search
CPC .... C21D 9/0081; C21D 9/0082; C21D 6/005; C21D 7/13; C21D 8/005; C21D 8/02;
(Continued)

(56) References Cited

U.S. PATENT DOCUMENTS 8,449,700 B2 5/2013 Senuma et al.
2009/0277539 A1 11/2009 Kimura et al.
(Continued)

FOREIGN PATENT DOCUMENTS

WO 02/29128 4/2002
WO WO-2013012103 A1 * 1/2013
(Continued)

OTHER PUBLICATIONS

International Search Report dated Sep. 9, 2014 in International PCT) Application No. PCT/JP2014/068313.
(Continued)

*Primary Examiner* — Jennifer A Smith
*Assistant Examiner* — Alexandra M Moore
(74) *Attorney, Agent, or Firm* — Wenderoth, Lind & Ponack, L.L.P.

(57) ABSTRACT

Provided is martensitic steel which is used in structures such as buildings and bridges, and automotive underbody, and mechanical parts such as gears and is more suitably used for steel products such as thick steel sheets, shape steel, a deformed steel bar, steel bars, or steel wires. The martensitic steel has a microstructure of a martensite structure containing a chemical composition, by mass %, of Si: 1.0 to 3.5%, Mn: 4.5 to 5.5%, Al: 0.001 to 0.080%, Nb: 0.045% or less, and C having an amount in which the following regression equation (1) is satisfied and the maximum stress (TS) becomes 1800 to 2160 MPa, a balance being Fe and inevitable impurities of: P: 0.030% or less, S: 0.020% or less, and N: 0.010% or less, the martensitic steel having total elongation of 13 to 15%.

$$TS(\text{maximum stress})\ [\text{MPa}]=4000\times C[\text{mass }\%]+1050 \quad (1).$$

2 Claims, 5 Drawing Sheets

(51) Int. Cl.

| | |
|---|---|
| ***C21D 8/06*** | (2006.01) |
| ***C22C 38/00*** | (2006.01) |
| ***C22C 38/04*** | (2006.01) |
| ***C22C 38/06*** | (2006.01) |
| ***C21D 6/00*** | (2006.01) |
| ***C21D 7/13*** | (2006.01) |
| ***B21J 5/00*** | (2006.01) |
| ***C21D 8/00*** | (2006.01) |
| ***C22C 38/02*** | (2006.01) |
| *C22C 38/12* | (2006.01) |

(52) U.S. Cl.
CPC ..... *C21D 8/005* (2013.01); *C21D 8/02* (2013.01); *C21D 8/021* (2013.01); *C21D 8/06* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C21D 2211/008* (2013.01); *C22C 38/12* (2013.01)

(58) Field of Classification Search
CPC .... C21D 8/021; C21D 8/06; C21D 2211/008; B21J 5/00; C22C 38/00; C22C 38/001; C22C 38/002; C22C 38/02; C22C 38/04; C22C 38/06; C22C 38/012
USPC ..... 420/103, 120; 148/330, 336, 337
See application file for complete search history.

(56) References Cited

U.S. PATENT DOCUMENTS

| | | | | |
|---|---|---|---|---|
| 2011/0048589 | A1* | 3/2011 | Matsuda | C21D 1/18 148/645 |
| 2014/0150930 | A1* | 6/2014 | Lee | C22C 38/001 148/518 |
| 2014/0205488 | A1* | 7/2014 | Jun | C22C 38/00 420/103 |

FOREIGN PATENT DOCUMENTS

| | | |
|---|---|---|
| WO | 2013/041541 | 3/2013 |
| WO | 2013/082188 | 6/2013 |

OTHER PUBLICATIONS

Takechi et al., "Transformation Hardening of Steel Sheet for Automotive Applications", JOM, vol. 60, No. 12, Dec. 2008, pp. 22-26.
Machine Translation of JP 2012-229455, Nov. 2012.
Machine Translation of JP 2007-321207, Dec. 2007.
Machine Translation of JP 2012-102346, May 2012.
Machine Translation of JP 2012-224884, Nov. 2012.

* cited by examiner

| | Surface treatment | Grain boundary of prior austenite | Packet | Block | Lath | Carbide |
|---|---|---|---|---|---|---|
| Optical microscope | Etching | ○ | △ | × | × | × |
| Scanning electron microscope | Etching | ○ | △ | × | × | △ |
| Transmission electron microscope | Thin film | × | × | △ | ○ | ○ |

● Martensite structure in which four-layer components are layered
(○: Observed △: Slightly observed ×: Not observed)

MARTENSITIC STEEL AND METHOD FOR PRODUCING SAME

TECHNICAL FIELD

The present invention relates to steel to be used in structures such as buildings and bridges, and automotive underbody, and mechanical parts such as gears, and particularly, to non-tempered martensitic steel suitable to be used for thick steel sheets, steel bars, or steel wires having high strength-high ductility-high toughness and a method for producing the same.

BACKGROUND ART

Recently, higher performance steel is demanded than ever with the enlargement of the structures or the weight reduction of the automotive parts. In addition to this, upon the production of the steel, resource saving and energy saving are also important issues. Then, upon the production of the steel, it is desirable to be capable of producing the steel by production processes less than the conventional production processes, without installing more or newly establishing facilities.

Conventionally, a number of high-strength steel sheets have been developed. For example, Patent Literature 1 discloses a technique related to an automotive cold-rolled steel sheet in which high strength and high ductility are achieved at the same time and press formability and impact energy absorbing capability are excellent. The cold-rolled steel sheet is a thin steel sheet in which strength is increased with refinement of ferrite crystal grains by suppression of the amount of expensive alloy elements to be added and the balance with ductility, which is important for press formability, is excellent. In a production process of the cold-rolled steel sheet, after hot rolling, cold rolling is performed and appropriate annealing is performed. However, according to this technique, expensive alloy elements such as Mo and Ni are added as an essential additive element, although being a small amount; and it is necessary to perform the annealing process on the thin steel sheet subjected to the rolling.

Further, Non Patent Literature 1 discloses a steel sheet (referred to as NewTRIP steel) in which steel similar to low carbon steel having a chemical composition of 0.1% C-5% Mn-2% Si with a high content of Mn and Si without the addition of expensive alloy elements is used and a work hardening exponent is increased during a low-temperature reheating treatment after annealing by the high content of Mn which increases the fraction of residual austenite, by the high content of Si which suppresses the generation of cementite, and by C which is discharged from ferrite to austenite and stabilizes the residual austenite. In this process, however, the thin steel sheet is required to be subjected to complex processes such as the annealing treatment and the low-temperature reheating treatment after being subjected to rolling, and a problem of process efficiency is not solved in terms of energy saving. Since the thin steel sheet is referred to as production target steel, a cold rolling process is also essential in addition to a hot rolling process.

Meanwhile, several types of high toughness steel to be used in structures or the like except for the thin steel sheet have been also developed as production target steel. For example, Patent Literature 2 discloses a technique related to high-strength steel in which delayed fracture resistance is excellent with high strength and high ductility and toughness is dramatically improved. According to this technique, steel is exemplified in which tensile strength is 1660 to 1800 MPa, elongation (total elongation) is 18.5 to 19.2%, and impact absorption energy of a V-notch Charpy test at a room temperature is 305 to 382 J/cm$^2$ (see Examples 1 and 17 indicated in Table 6 in Patent literature 2). However, even in this technique, expensive Mo of about 1.0% is contained as a chemical composition, and after any one of annealing, tempering, and aging is performed as a production process under predetermined conditions of temperature and time, working (warm working) is required at a temperature of 350° C. or higher but ($A_{C1}$−20° C.) or lower.

Furthermore, as techniques proposed by the present inventors, there are Patent Literatures 3, 4, and 5. Here, the structure of the steel disclosed in Patent Literatures 4 and 5 differs from the intended structure (martensite) of the present invention in terms of being two-phase structure of $\alpha/\gamma$. In addition, mechanical properties of the steel disclosed in Patent Literatures 4 and 5 also differ from those of the martensitic steel of the present invention in that the strength of the present invention is relatively high and the ductility is low compared to the $\alpha/\gamma$ structures.

In addition, since Patent Literature 3 discloses martensite structure steel, structures or mechanical properties of the steel are similar to those of the martensitic steel of the present invention. However, since the composition of the steel disclosed in Patent Literature 3 has the range of 0.05 to 0.2% of C in terms of the composition, there is a problem that tensile strength TS is only a level of 1400 MPa due to the very low content of C, and thus it is not possible to obtain tensile strength of a level of 2000 MPa which is an index. In addition, in view of characteristics of the steel disclosed in Patent Literature 3, there is a general nature of carbon steel that the ductility deteriorates as the high strength increases.

As described above, according to the techniques disclosed so far, the problems of resource saving and energy saving are not solved, and a large load is applied to a working apparatus in a normal production line for carrying out warm working at a relatively low-temperature range, so that there is a problem in industrially wide use.

In addition, when there is a demand to change the level of high strength, the level of high strength can be easily changed by increasing or lowering of the content of C. However, there is a contradictory problem that the ductility is lowered when the strength is increased by the increasing of the content of C, whereas the strength is lowered when the ductility is increased by the lowering of the content of C.

CITATION LIST

Patent Literature 1: JP 2007-321207 A
Patent Literature 2: WO 2007/058364 A
Patent Literature 3: JP 2012-102346 A
Patent Literature 4: JP 2012-224884 A
Patent Literature 5: JP 2012-229455 A
Non Patent Literature 1: H. Takechi, Journal of Metals. December 2008, p. 22

SUMMARY OF INVENTION

Technical Problem

The present invention has been made in view of the above circumstances, and an object thereof is to provide martensitic steel and a method for producing the same in which the following problems are solved, but cannot be solved in the prior art.

(1) Use of steel to be produced is applied to structures such as buildings or bridges, automotive underbody steel, and mechanical parts such as gears, and examples of types of the steel to be produced include a thick steel sheet, shape steel, a deformed steel bar, a steel bar, and a steel wire which are excellent as high strength.

(2) The composition of steel is based on low-C steel with the addition of inexpensive Mn and Si, but the addition of expensive alloy elements such as Mo and Ni is not necessary.

(3) The structure can be controlled by existing rolling equipment provided in a normal steel mill without being subjected to a special annealing treatment.

(4) With respect to material characteristic values of the steel as a production target, strength and ductility as mechanical properties are balanced in such a manner that maximum stress (TS) can be varied from 1800 MPa to 2160 MPa while total elongation (TE) in a tensile test is maintained at 13 to 15%.

Solution to Problem

In order to solve the above problems, the present inventors intensively studied a new combination of microstructure-type phases of steel and relation between a composition ratio of the steel and material characteristic values. From results of the studying of production conditions to obtain these structures, the present inventors have achieved the present invention. The present invention has the following characteristics.

Martensitic steel of the present invention, which solves the above problems, having a microstructure of a martensite structure, contains a chemical composition, by mass %, of:

Si: 1.0 to 3.5%,

Mn: 4.5 to 5.5%,

Al: 0.001 to 0.080%,

Nb: 0.045% or less, and

C having an amount in which the following regression equation (1) is satisfied and the maximum stress (TS) becomes 1800 to 2160 MPa, a balance being Fe and inevitable impurities of:

P: 0.030% or less,

S: 0.020% or less, and

N: 0.010% or less, in which the martensitic steel has total elongation of 13 to 15%.

$$\text{TS(maximum stress) [MPa]}=4000\times C\text{[mass \%]}+1050 \quad (1)$$

Thus, the martensitic steel having excellent mechanical balance properties with the strength-ductility balance is obtained.

According to a method for producing martensitic steel of the present invention, a material is prepared which contains a chemical composition, by mass %, of:

Si: 1.0 to 3.5%,

Mn: 4.5 to 5.5%,

Al: 0.001 to 0.080%,

Nb: 0.045% or less, and

C having an amount in which the following regression equation (1) is satisfied and the maximum stress (TS) becomes 1800 to 2160 MPa, a balance being Fe and inevitable impurities of:

P: 0.030% or less,

S: 0.020% or less, and

N: 0.010% or less.

$$\text{TS(maximum stress) [MPa]}=4000\times C\text{[mass \%]}+1050 \quad (1)$$

The material is referred to as a steel ingot in FIG. 2. As illustrated in FIG. 2, the material is uniformly heated at 1200° C.±25° C., and is air-cooled to a room temperature (S108) after being subjected to working with a reduction ratio of area of 84% or more by continuous forging in a temperature range of from 1200° C. to 750° C. (S106). Thus, martensitic steel having a steel structure of a fine microstructure consisting of martensite having an average block grain size of 5.0 μm or less in a cross section in a direction vertical to a rolling direction is obtained.

A uniform heating temperature of S104 in FIG. 2 is a temperature at which austenite is in an equilibrium state, and the range of the uniform heating temperature is determined by the relation with a hot-working apparatus as long as being suitable for hot working and obtaining fine microstructures. When the uniform heating temperature of a steel ingot is higher than 1225° C., since a working temperature becomes higher, grains of an average block size are not sufficiently refined and the required strength is hardly obtained. When the uniform heating temperature of the steel ingot is lower than 1175° C., since the working temperature becomes lower, resistance increases during forging and a reduction ratio of area is hardly ensured up to 84% or more.

Advantageous Effects of Invention

According to the present invention, high-strength steel is obtained using low-carbon steel without expensive alloy additive elements, and martensitic steel having superior mechanical balance properties is also obtained in which strength TS can be varied from 1800 MPa to 2160 MPa while ductility is maintained at a certain level (TE: 13 to 15%) only by variation of the content of C.

In addition, upon the production of steel such as a superior thick steel sheet, shape steel, a deformed steel bar, a steel bar, and a steel wire, steel having a chemical composition of low-carbon steel without the addition of the expensive alloy elements as disclosed in Non Patent Literature 1 can be used, and low cost high-strength steel is obtained.

According to the method for producing the martensitic steel of the present invention, since martensitic steel having superior mechanical balance properties in which the strength TS can be varied from 1800 MPa to 2160 MPa while the ductility is maintained at a certain level (TE: 13 to 15%) can be produced by hot forging in the present production line in which an excessive load is not applied to production equipment, it is possible to produce desired steel conforming to the standard of various types of strength.

DESCRIPTION OF EMBODIMENTS

Figure 1:
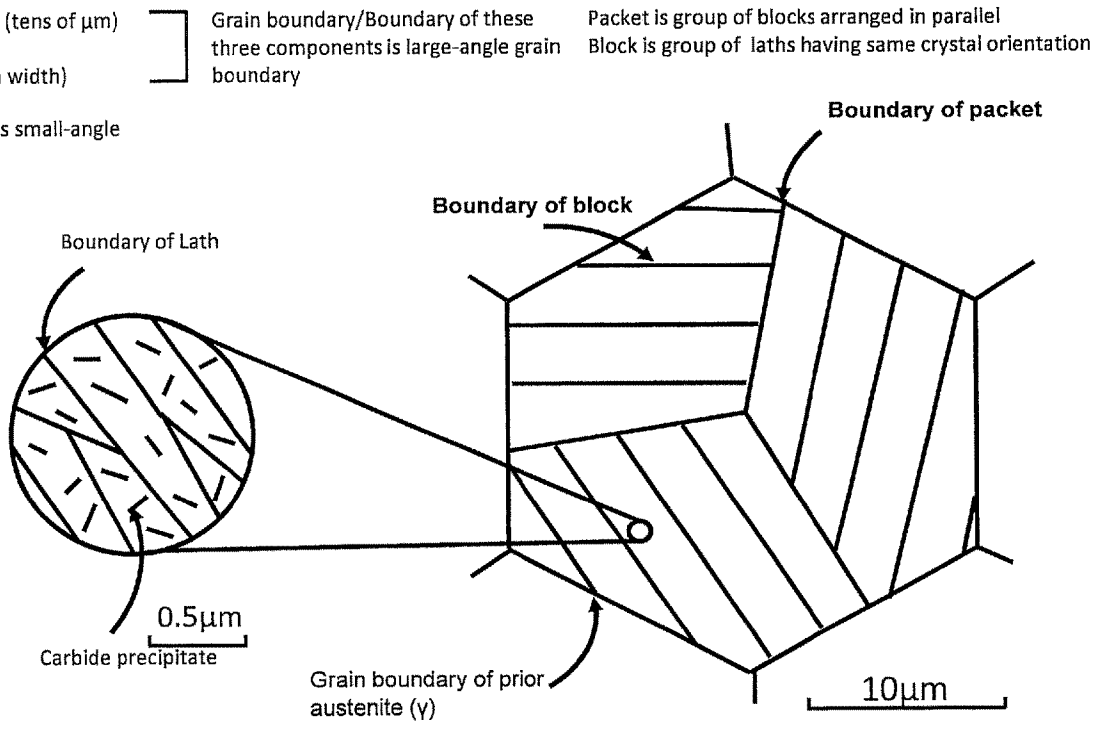
FIG. 1 is an explanatory diagram of a layered structure consisting of four-layer components in a martensite structure.

Hereinafter, a description will be given with respect to a chemical composition, microstructures and mechanical properties of martensitic steel according to an embodiment, and features of a method for producing the martensitic steel in detail.

<Chemical Composition of Martensitic Steel>

The martensitic steel according to the present embodiment has a chemical composition in the following range (hereinafter, all percentages (%) of the composition indicate a percentage (%) by mass).

C: The amount of C is set such that the regression equation (1) is satisfied and TS becomes 1800 to 2160 MPa. That is, the content of C (hereinafter, also referred to as a C-concentration) is 0.1875 to 0.2775%. C is necessary to ensure tensile strength, but the tensile strength required for the martensitic steel according to the present embodiment is not sufficiently satisfied when the C-concentration is less than 0.1875%. On the other hand, when the C-concentration exceeds 0.2775%, tensile strength is out of the range of the tensile strength of the martensitic steel according to the present embodiment, and ductility and weldability tend to decrease, whereby it is not possible to obtain martensitic steel having excellent balance between strength and ductility. A calculation method of the above regression equation (1) will be described below in detail.

Si: The amount of Si is set from 1.0% to 3.5%. Si is a substitutional solid solution reinforcing element for largely hardening a material and is also an element effective to increase hardness of steel. The content of Si is preferably 1.0% or more. However, when the content of Si becomes too high, many of Si-scales occur during heating at the time of hot working, and thus there are problems that excess costs are spent for removal of the scales and surface defects are easily caused by the scales. Therefore, the upper limit of the amount of Si is set to be 3.5%.

Mn: The amount of Mn is set from 4.5% to 5.5%.

In order to generate martensite at low-temperature range working of 400° C. or higher, it is necessary to highly stabilize austenite. The large content of Mn acts effectively on the stabilization of the austenite.

In order to sufficiently exhibit the action and effect, the content of Mn is preferably set to be 4.5% or more. On the other hand, low-temperature toughness of the steel is deteriorated when the concentration of Mn becomes high, and Mn is excessively segregated in the steel during solidification and homogeneity inside the material is impaired when the concentration of Mn becomes excessively high. In addition, surface cracks easily occur during a hot working process in a preparation process of the material. Accordingly, the upper limit of the amount of Mn is set to be 5.5%.

Al: The amount of Al is set from 0.001% to 0.080%. Al is added for deoxidizing molten steel, but the additive effect of Al is insufficient even in the case of using a vacuum melting furnace when the content of Al is less than 0.001%. In general, in the case of converter refining, the content of Al is preferably 0.001% or more to achieve sufficient deoxidization. On the other hand, when the content of Al exceeds 0.080%, an embrittlement problem may be caused by the generation of AlN and toughness may be also impaired by an increase of oxide inclusions. Accordingly, the upper limit of the amount of Al is set to be 0.080%. In the present invention, on the assumption of the case of a small production using a vacuum melting furnace in addition to the case of not performing the vacuum refining using a converter steelmaking method or an electric furnace steelmaking method which are industrial production methods in general, as a melting process of the steel, the lower limit value of the amount of Al is defined.

Nb: The amount of Nb is set to be 0.045% or less. Nb has an effect of fining a structure by finely dispersing carbides into steel. This reason is that Nb reacts with C contained in the steel to generate NbC and fine precipitates suppresses the growth of γ grains existing in a γ region of a high temperature by grain boundary pinning. When the amount of Nb to be added is 0.045% or more, there are risks of consuming a carbon in the steel, thereby lowering a driving force of martensite transformation and deteriorating characteristics of the steel.

In the chemical composition of the martensitic steel according to the present embodiment, the balance is Fe and inevitable impurities. The inevitable impurities contain P, S, and N which will be described below. In addition, the inevitable impurities may contain O. It is preferable that O is not contained in the steel. The content of O can be reduced by deoxidation, but O contained in the steel may be remained without being completely removed.

P: The amount of P is set to be 0.030% or less. P is an impurity element which is inevitably mixed into the steel and reduces toughness. Accordingly, the upper limit of the content of P is limited to 0.030%. In addition, the upper limit of the content of P is more preferably 0.015% or less. The lower limit value thereof is not particularly limited, but may be suitably determined in consideration of costs.

S: The amount of S is set to be 0.020% or less. Similarly to P, S is an impurity element which is inevitably mixed into the steel and impairs workability and toughness. Accordingly, the upper limit of the content of S is limited to 0.020%. In addition, the upper limit of the content of S is more preferably 0.005%. The lower limit value thereof is not particularly limited, but may be suitably determined in consideration of costs.

N: The amount of N is set to be 0.010% or less. N is an element which is inevitably contained in the steel. Degasification refining or the like is necessary to actively reduce the amount of N, resulting in increasing production costs. In addition, since N also depends particularly on the content of N in a raw material in the case of an electric furnace steelmaking method, the lower limit is not particularly specified. On the other hand, when the content of N exceeds 0.010%, nitrides increase and thus toughness is impaired. Accordingly, the upper limit is set to be 0.010%.

<Microstructure and Mechanical Characteristic Value>

Microstructure of the martensitic steel according to the present embodiment will be described.

The microstructure of the martensitic steel according to the present embodiment is characterized in that a main phase is martensite and Vickers hardness is HV>400 which corresponds to hardness of martensite. Thus, it is characterized in that high strength can be achieved by normal compositions, while the high strength cannot be achieved unless expensive alloy elements are added. Such microstructure is one of requirements to meet a required mechanical characteristic value, and as prerequisite of such a requirement, the martensitic steel should satisfy the chemical composition described above.

The martensite structure has a complex layered structure consisting of four components. FIG. 1 is an explanatory diagram of the layered structure consisting of four-layer components in the martensite structure. A crystal grain having a prior austenite phase of tens of micrometers in size becomes a structure in which packets having a size of several micrometers are compacted, the packet being formed by an elongated plate-like block having a width of about 1 μm which is compacted.

The block is constituted by a lath. That is, the martensite structure is formed by stacking of four components such as a prior austenite-phase grain, a packet, a block, and a lath. The martensite structure has a very complex layered structure in which carbide grains having a size of several to tens of nanometers are dispersed in a grain boundary/boundary of four components or in a grain.

Each of the prior austenite grain boundary, the packet, the block, the lath, and the carbide of the martensite structure can be observed by any one of an optical microscope, a scanning electron microscope, and a transmission electron microscope as illustrated in FIG. 1.

In addition, the martensitic steel according to the present embodiment is characterized in that a maximum stress (TS) value can be improved from 1800 MPa to 2160 MPa while total elongation is maintained at from 13% to 15% with respect to the mechanical properties in a nominal stress-nominal strain curve. That is, there is a general tendency that ductility decreases as strength increases under ordinary circumstances, but the martensitic steel according to the present embodiment is characterized in that high strength is controlled while the decrease in ductility is suppressed.

In the present embodiment, the total elongation is measured by a tensile test. Conditions of the tensile test are as follows:

Conditions of Tensile Test

Sample: Round-bar test piece, Gauge section: Radius ϕ of 3.5 mm and length of 24 mm Tensile condition: Strain rate of 0.5 mm/min.

Length of strain gauge: 17.5 mm

Furthermore, in the present embodiment, the maximum stress is a stress value of a maximum load point in the nominal stress-nominal strain curve.

The martensitic steel according to the present embodiment satisfies the following Equation (2) as a mechanical characteristic value:

$$\text{Hardness (HV)} \geq 400 \quad (2).$$

The martensitic steel having the chemical composition described above and having such a mechanical characteristic value has not been found until now.

<Method for Producing Martensitic Steel>

A production method of obtaining the martensitic steep according to the present embodiment will be described below.

In the method for producing the martensitic steel according to the present embodiment, a material (steel ingot) is prepared which contains chemical composition, by mass %, of:

Si: 1.0 to 3.5%,

Mn: 4.5 to 5.5%,

Al: 0.001 to 0.080%,

Nb: 0.045% or less, and

C: 0.20% or more in which the following regression equation (1) is satisfied and the maximum stress (TS) becomes 1800 to 2160 MPa, a balance being Fe and inevitable impurities of:

P: 0.030% or less,

S: 0.020% or less, and

N: 0.010% or less, $$\text{TS(maximum stress) [MPa]} = 4000 \times C\text{[mass \%]} + 1050 \quad (1).$$

The chemical composition of the material are similar to those of the martensitic steel described above, so the description thereof will not presented.

Then, the material is uniformly heated at 1200° C.±25° C. and is air-cooled to a room temperature after being subjected to working with reduction ratio of area of 84% or more by continuous forging in a temperature range of from 1200° C. to 750° C. Here, upon forging in the temperature range of from 1200° C. to 750° C., for example, a temperature at the time of starting the forging can be 1200° C. and a temperature at the time of finishing the forging can be 750° C. By this, it is possible to obtain the martensitic steel having superior mechanical balance properties in that the strength can be made variable from 1800 MPa to 2160 MPa in TS while the ductility is maintained at a certain level (TE: 13 to 15%).

In the method for producing the martensitic steel according to the present embodiment, the uniform heating temperature is described above, but is a temperature at which austenite is in an equilibrium state and is a temperature at which a fine microstructure is obtained with suitable hot working. The range of the uniform heating temperature is determined in relation to a hot-working apparatus. When the uniform heating temperature of the material is higher than 1225° C., since a working temperature becomes higher, grains having an average block size are not sufficiently atomized and the required strength is hardly obtained. When the uniform heating temperature of the material is lower than 1175° C., since a working temperature becomes lower, resistance increases during the forging and the reduction ratio of area of 84% or more is hardly ensured.

The continuous forging in the method for producing the martensitic steel according to the present embodiment will be described below. Hereinafter, the description is given with respect to an example in which steel of 0.2% C-2% Si-5% Mn is used as the material, but the description with respect to this example is similarly described on the case of using a material having the chemical composition of martensitic steel described above.

[Hot Plastic Working Conditions of Material (Steel of 0.2% C-2% Si-5% Mn)]

A hot plastic working method of the material may include any one of flat rolling in a thick steel sheet producing line which is industrially performed, forging in a very thick steel sheet producing line, groove rolling in steel bar or steel wire producing line, and shape rolling in a billet steel or shape steel producing line. By any one of these working methods, a desired plastic equivalent strain is applied to the material.

By the working methods described above, a compressive strain to be introduced to the material and a shearing strain occurring in the material become different from each other in direction. Therefore, an example of a method of theoretically calculating the plastic strain with respect to the amount or distribution of total stress components or total strain components may include a finite element method (FEM). The calculation of the plastic strain is described in a reference literature (Keizaburo Ham, et al. "Introduction to finite element method," Kyoritsu Shuppan Co., Ltd, Mar. 15, 1990) in detail. However, a plastic equivalent strain may be used herein in terms of industrially simple use. The plastic strain obtained by the calculation according to the finite element method is further preferably used, but plastic equivalent strain (e) defined by the following Equation (3) is used herein as an indicator of the plastic strain in terms of industrially simple use.

$$e = \cdot \ln(1 - R/100) \quad (3)$$

In Equation (3), R indicates reduction ratio of area (%). When a cross-sectional area of the material in C-direction is defined as $S_0$ and a cross-sectional area in C-direction after hot working is defined as S, R is represented by the following Equation (4).

$$R = \{(S_0 - S)/S_0\} \times 100 \quad (4)$$

After being subjected to the continuous forging described above to the reduction ratio of area of 84% or more, the material is air-cooled to a room temperature, martensitic steel having a steel structure of a fine microstructure consisting of martensite having an average block grain size of 5.0 μm or less in a cross section in a direction vertical to a rolling direction is obtained. Here, the average block grain size can be measured using, for example, an electron back scattering pattern (EBSP) apparatus. Specifically, a region of 275 μm×165 μm is measured at each of the range from the surface layer to 0.1 D and a range from the ¼ D part (a part kept off for ¼ of the diameter D of a steel wire from the surface of the steel wire in a center direction of the steel wire) to the ½ D part (the center part of the steel wire) at the wire material cross section vertical to the longitudinal direction of the wire material. A boundary where an orientation difference becomes 10° or more from a crystal orientation map of a bcc structure measured by the EBSP device is set to be a block grain boundary. A circle-equivalent grain size of one block grain is defined as a block grain size, and a volume average thereof is defined as an average grain size.

In Examples to be described below, a 95 mm-square steel ingot (material) of 0.2% C-2% Si-5% Mn in the range of the chemical composition described above is heated at 1200° C. for 60 minutes and is then forged and compressed to a square of 38 mm. A structure obtained at this time had a main phase consisting of martensite of approximately 100% by volume and hardness (HV) is not less than 400.

<Calculation Method of Regression Equation (1)>

Subsequently, a calculation method of the regression equation (1) will be described. The regression equation (1) is represented by a relation formula between the maximum stress of the martensitic steel and the C-concentration in the martensitic steel. Here, since the martensitic steel is produced in a manner similar to that described in the <method for producing the martensitic steel> described above, the description of the method for producing the same will not be presented.

The details of chemical composition of the martensitic steel material for calculating the regression equation (1) are as follows. The chemical composition of the martensitic steel obtained from this material also matches the chemical composition of the material. In the chemical composition, compositions and concentrations other than C are similar to the chemical composition of the martensitic steel according to the present embodiment described above. The following unit % is mass % in all compositions.

The martensitic steel material contains:

C: 0.05 to 0.30%,

Si: 1.0 to 3.5%,

Mn: 4.5 to 5.5%,

Al: 0.001 to 0.080%, and

Nb: 0.045% or less a balance being Fe and inevitable impurities of:

P: 0.030% or less,

S: 0.020% or less, and

N: 0.010% or less.

In the calculation of the regression equation (1), first, a plurality of types of martensitic steel satisfying the above chemical composition and having different C-concentration are produced using the above method, and subsequently, the maximum stress is each measured for the plurality of types of martensitic steel which are produced. Data of maximum stress for the plurality of types of martensitic steel obtained by this way is plotted using a horizontal axis which is set as the C-concentration in the martensitic steel and a vertical axis which is set as the maximum stress (tensile strength) of the martensitic steel. A regression line is obtained from the plotted data by a least-square method. The regression line is the regression equation (1).

In Examples to be described below, a regression equation (7) is obtained based on samples 1 to 6 (martensitic steel) produced from materials of a chemical composition indicated in Tables 1 and 2. The regression equation (7) is the regression equation (1). Even in materials having a chemical composition other than those indicated in Tables 1 and 2, when the materials have the range of the chemical composition described above, the regression equation (7) can be obtained based on a sample (martensitic steel) produced from the materials.

EXAMPLE

Hereinafter, the present invention will be described in more detail by Examples. The present invention is not limited to the following Examples, but can be also appropriately modified within the range that can be suitable for the above and below spirit. All of these are included in the technical scope of the present invention.

Figure 2:
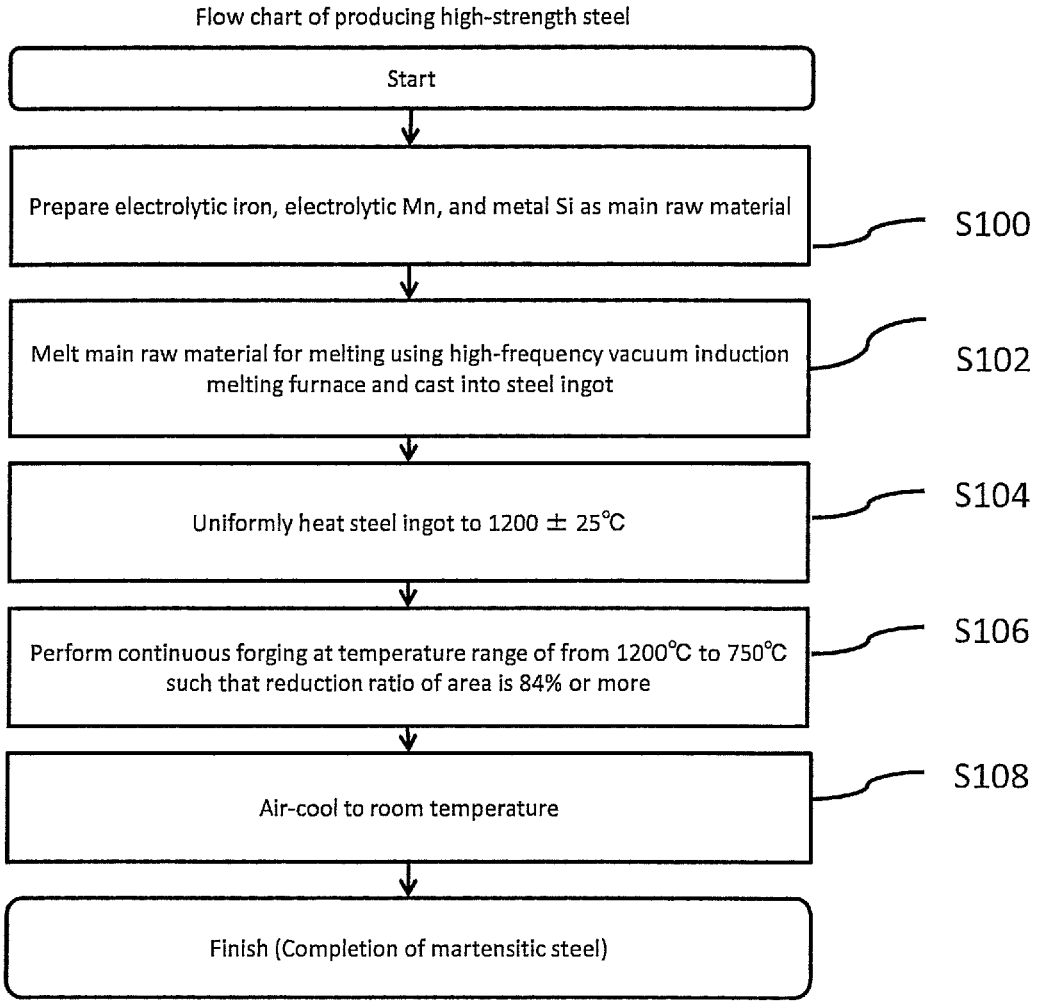
FIG. 2 is a flowchart illustrating a method for producing martensitic steel.

FIG. 2 is a flowchart illustrating a method for producing the martensitic steel according to the present embodiment. Based on the flowchart illustrated in FIG. 2, the production of the martensitic steel will be described below in detail. FIG. 2 is also flowchart illustrating a method for producing the martensitic steel for obtaining the regression equation (1).

<Calculation of Regression Equation>

First, electrolytic iron, electrolytic Mn, and metal Si are prepared as a main raw material for melting (S100). Subsequently, the main raw material for melting is melted using a high-frequency vacuum induction melting furnace, and is then cast into a steel ingot of 95 mm length×95 mm width×450 mm height (S102). The cast steel ingot is referred to as a material of the martensitic steel and six materials (materials 1 to 6) having different C-concentration was prepared. Chemical compositions of the materials 1 to 6 are indicated in Table 1. In Table 2, a chemical composition of inevitable impurities of the materials 1 to 6 was indicated. In the materials 1 to 6, the C-concentration is varied with 0.05%, 0.075%, 0.125%, 0.15%, 0.2, and 0.3%, but the contents of silica, manganese, and aluminum are not varied, which are 1.96%, 5.02%, and 0.001%, respectively. Each of the contents of phosphorus, sulfur, oxygen, and nitrogen contained as the inevitable impurities is common in the materials 1 to 6.

TABLE 1

| | Chemical composition (unit: mass %) | | | | |
|---|---|---|---|---|---|
| | C | Si | Mn | Al | Fe and inevitable impurities |
| Material 1 | 0.05 | 1.96 | 5.02 | 0.001 | Balance |
| Material 2 | 0.075 | 1.96 | 5.02 | 0.001 | Balance |
| Material 3 | 0.125 | 1.96 | 5.02 | 0.001 | Balance |
| Material 4 | 0.15 | 1.96 | 5.02 | 0.001 | Balance |
| Material 5 | 0.2 | 1.96 | 5.02 | 0.001 | Balance |
| Material 6 | 0.3 | 1.96 | 5.02 | 0.001 | Balance |

TABLE 2

| | Inevitable impurities (unit: mass %) | | | |
|---|---|---|---|---|
| | P | S | N | O |
| Material 1 | 0.001 | 0.001 | 0.0005 | 0.0002 |
| Material 2 | 0.001 | 0.001 | 0.0005 | 0.0002 |
| Material 3 | 0.001 | 0.001 | 0.0005 | 0.0002 |
| Material 4 | 0.001 | 0.001 | 0.0005 | 0.0002 |
| Material 5 | 0.001 | 0.001 | 0.0005 | 0.0002 |
| Material 6 | 0.001 | 0.001 | 0.0005 | 0.0002 |

Subsequently, the 95 mm-square material (steel ingot) is heated to 1200° C. and is then held for one hour (S104). Thereafter, the material having the square cross section of 95 mm length×95 mm width is subjected to six sets of press forging without being re-heated on the way, and is forged up to a square cross section of 38 mm length×38 mm width (referred to as a 38 mm square; hereinafter, this representation may be expressed in the following description), wherein one set of press forging means that the length and the width are alternately press-forged by one. Finally, the material is wholly straightened into a linear shape, and the material obtained thus was referred to as a 38 mm square bar material (S106). In the hot forging, a reduction ratio of area (R) from the 95 mm square to the 38 mm square was 84.0%, and the plastic equivalent strain (e) was 1.83. In the hot forging, a temperature at the time of staring the forging was 1200° C., and a temperature at the time of finishing the forging was 750° C. Thereafter, the bar material was immediately air-cooled to be cooled to a room temperature (S108).

Here, the reduction ratio of area (R) and the plastic equivalent strain (e) were calculated by the following Equations (5) and (6). So represents a cross-sectional area in a vertical direction (C direction) to a rolling direction of the material, and S represents a cross-sectional area in the vertical direction (C direction) to the rolling direction after hot working.

$$R=\{(S_0-S)/S_0\}\times 100 \quad (5)$$

$$e=\cdot\ln(1-R/100) \quad (6)$$

A microstructure of the 38 mm square bar material obtained by the hot forging had a main phase of lath martensite of 95% or more by volume. In this structure state, hardness (HV) was 400 or more. This bar material serving as a base material was cut into a bar of 15 mm square, and the bar was used as a sample for a regression equation calculation. Hereinafter, a sample obtained using a material 1 was referred to as a sample 1. Similarly, samples obtained using materials 2, 3, 4, 5, and 6, were referred to as samples 2, 3, 4, 5, and 6, respectively.

Figure 3:
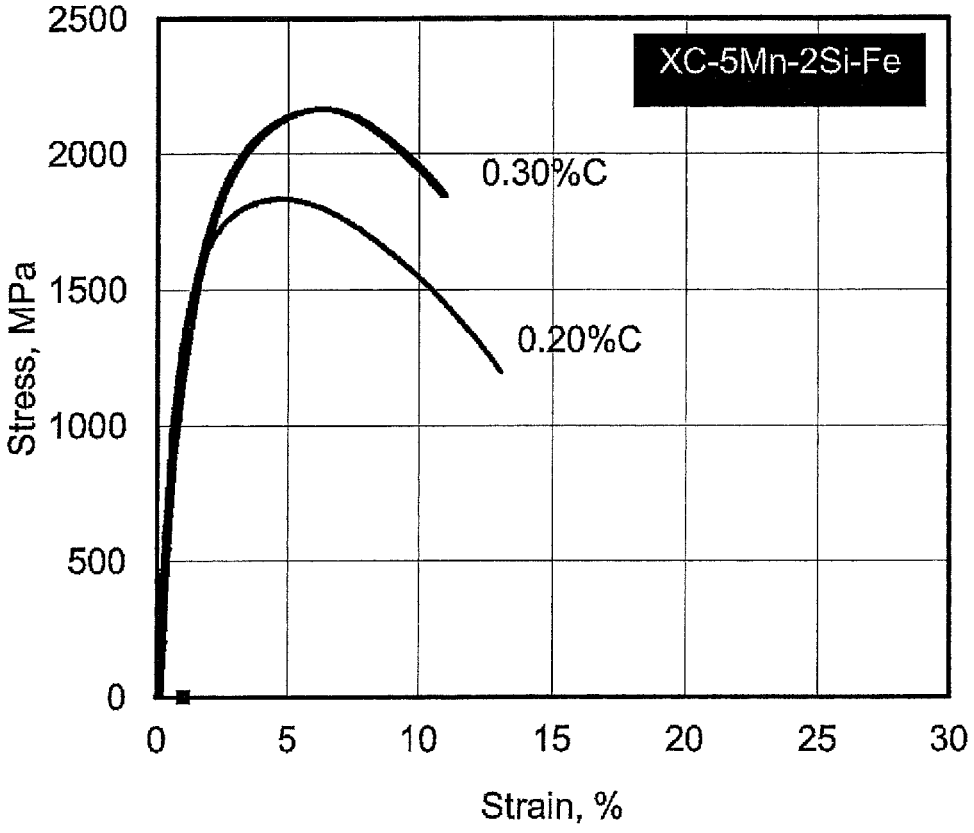
FIG. 3 is a diagram illustrating tensile property of materials 5 and 6 each having the content of C of 0.20 mass % and 0.30 mass % in Example.
Figure 4:
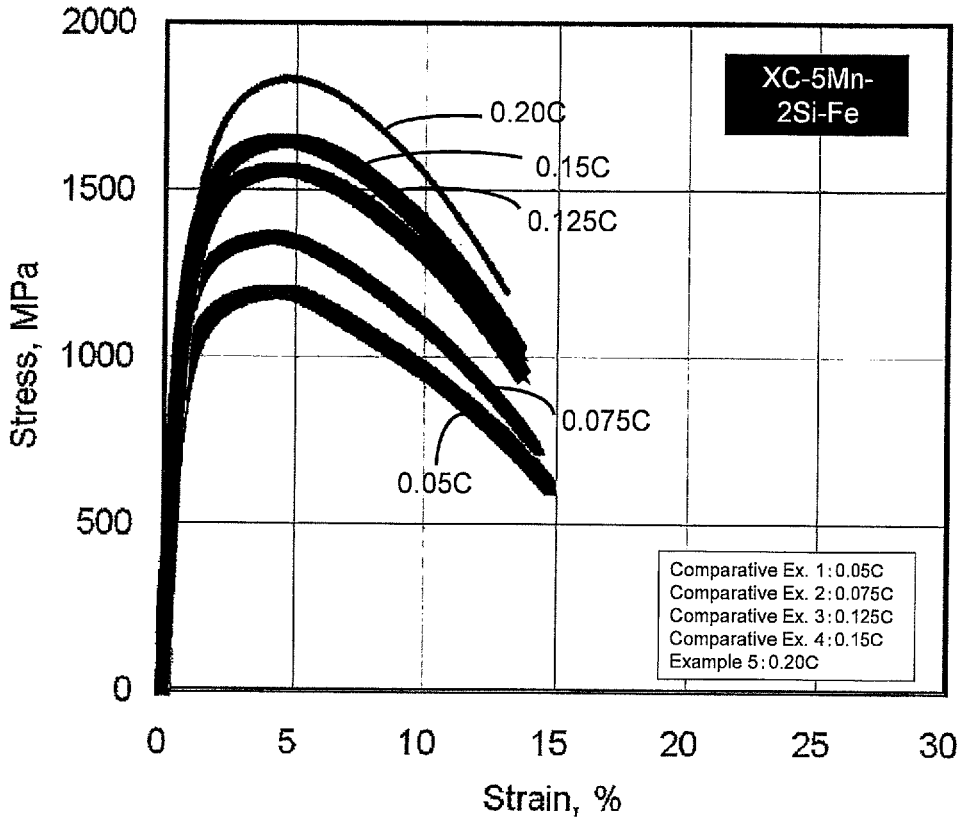
FIG. 4 is a diagram illustrating tensile property of materials 1, 2, 3, 4, and 5 each having the content of C of 0.05 mass %, 0.075 mass %, 0.125 mass %, 0.15 mass %, and 0.20 mass % in Example.
Figure 5:
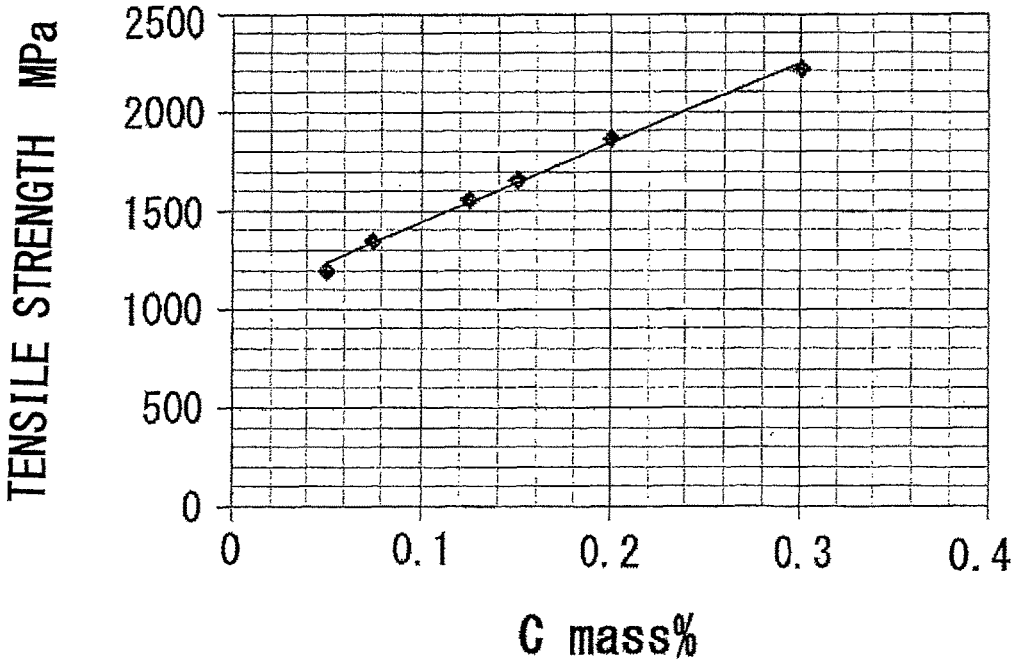
FIG. 5 is a diagram illustrating maximum stress data in the content of C in the samples 1 to 6 illustrated in FIGS. 3 and 4 and a regression equation calculated on the basis of the data.

Mechanical test results of the samples 1 to 6 are summarized in FIGS. 3 to 5. FIG. 3 is a diagram illustrating tensile property (nominal stress-nominal strain curve) of the samples 5 and 6 each having the C-concentration of 0.20% and 0.30%, and FIG. 4 is a diagram tensile property of the samples 1, 2, 3, 4, and 5 each having the C-concentration of 0.05%, 0.075%, 0.125%, 0.15%, and 0.20% by mass. FIG. 5 is a diagram illustrating maximum stress data in the C-concentration in the samples 1 to 6 illustrated in FIGS. 3 and 4 and a regression equation calculated on the basis of the data. With reference to FIGS. 3 and 4, a person skilled in the art understands that the nominal stress-nominal strain curves due to the difference in the C-concentration are similar to each other in terms of a basic curve shape and the position of the curve is raised only as the amount of C increases. The regression equation based on FIG. 5 is expressed by the following Equation (7).

$$RS\ [MPa]=4000\times C[mass\ \%]+1050 \quad (7)$$

Here, $0.05\leq C\ [mass\ \%]\leq 0.30$.

EXAMPLE

Electrolytic iron, electrolytic Mn, and metal Si are prepared as a main raw material for melting (S100). Subsequently, the main raw material for melting is melted using a high-frequency vacuum induction melting furnace, and is then cast into a steel ingot of 95 mm length×95 mm width×450 mm height (S102). The cast steel ingot was prepared as a material 7 of the martensitic steel. A chemical composition of the material 7 is indicated in Table 3. In Table 4, a chemical composition of inevitable impurities of the material 7 was indicated.

TABLE 3

| | Chemical composition (unit: mass %) | | | | |
|---|---|---|---|---|---|
| | C | Si | Mn | Al | Fe and inevitable impurities |
| Material 7 | 0.2 | 1.96 | 5.02 | 0.001 | Balance |
| Material 8 | 0.05 | 1.96 | 5.02 | 0.001 | Balance |
| Material 9 | 0.075 | 1.96 | 5.02 | 0.001 | Balance |
| Material 10 | 0.125 | 1.96 | 5.02 | 0.001 | Balance |
| Material 11 | 0.15 | 1.96 | 5.02 | 0.001 | Balance |

TABLE 4

| | Inevitable impurities (unit: mass %) | | | |
|---|---|---|---|---|
| | P | S | N | O |
| Material 7 | 0.001 | 0.001 | 0.0005 | 0.0002 |
| Material 8 | 0.001 | 0.001 | 0.0005 | 0.0002 |
| Material 9 | 0.001 | 0.001 | 0.0005 | 0.0002 |
| Material 10 | 0.001 | 0.001 | 0.0005 | 0.0002 |
| Material 11 | 0.001 | 0.001 | 0.0005 | 0.0002 |

Subsequently, the material (steel ingot) having the square of 95 mm×95 mm is heated to 1200° C. and is then held for one hour (S104). Thereafter, the material having the square cross section of 95 mm length×95 mm width is subjected to six sets of press forging alternatively by one without being re-heated on the way, and is forged up to a square cross section of 38 mm length×38 mm width, and finally, the material is wholly straightened into a linear shape, and the material obtained thus was referred to as a 38 mm square bar material (S106). In the hot forging, a reduction ratio of area (R) from the 95 mm square to the 38 mm square was 84.0%, and the plastic equivalent strain (e) was 1.83. In the hot forging, a temperature at the time of staring the forging was 1200° C., and a temperature at the time of finishing the forging was 750° C. Thereafter, the bar material was immediately air-cooled to be cooled to a room temperature (S108).

Here, the reduction ratio of area (R) and the plastic equivalent strain (e) were calculated by the above Equations (5) and (6).

A microstructure of the 38 mm square bar material obtained by the hot forging had a main phase of lath martensite of 95% or more by volume. In this structure state, hardness (HV) was 400 or more. This bar material serving as a base material was cut into a bar of 15 mm square, and the bar was used as a testing material. Hereinafter, the bar material and the testing material obtained using the material 7 are referred to as a bar material 1 and a testing material 1.

From measurement results of material characteristic values (total elongation and maximum stress) of the testing material 1, the total elongation was 13%, and the maximum stress was 1850 MPa.

Comparative Examples 1 to 4

Bas materials and testing materials were obtained in the same manner as in Example except that materials 8, 9, 10, and 11 indicated in Tables 3 and 4 were used instead of the material 7 of Example. Here, bar materials and testing materials obtained using the materials 8, 9, 10, and 11 are referred to as bar materials 2, 3, 4, and 5 and testing materials 2, 3, 4, and 5, respectively.

From investigation results of the microstructure of each of the bar materials 2, 3, 4, and 5, all of the bar materials had a main phase of lath martensite of 95% or more by mass. In the structure state of each bar material, hardness (HV) was 400 or more. From measurement results of material characteristic values (total elongation and maximum stress) for each of the testing materials 2, 3, 4, and 5, the following characteristic values were obtained.

Testing material 2: total elongation 15% and maximum stress 1150 MPa,

Testing material 3: total elongation 14% and maximum stress 1350 MPa,

Testing material 4: total elongation 13% and maximum stress 1550 MPa, and

Testing material 5: total elongation 13% and maximum stress 1650 MPa.

Above, the testing material 1 obtained in Example was confirmed to be martensitic steel in which the total elongation was 13 to 15%, the maximum stress was 1800 to 2160 MPa, and the ductility and the strength were balanced. From this, it was found that the martensitic steel having the microstructure of the martensite structure contains the following chemical composition, by mass %, is martensitic steel having superior mechanical balance properties in that the strength can be made variable from 1800 MPa to 2160 MPa in maximum stress while the ductility is maintained at a certain level (total elongation: 13 to 15%):

Si: 1.0 to 3.5%, Mn: 4.5 to 5.5%, Al: 0.001 to 0.080%, Nb: 0.045% or less, and C having an amount in which the following regression equation:

$$TS(\text{maximum stress})\ [\text{MPa}]=4000\times C[\text{mass }\%]+1050$$

is satisfied and the TS becomes 1800 to 2160 MPa, a balance being Fe and inevitable impurities of: P: 0.030% or less, S: 0.020% or less, and N: 0.010% or less. Accordingly, it is possible to obtain the steel having the superior balance between the ductility and the strength even in the steel composition without the expensive alloy elements such as Ni and Mo.

Meanwhile, all of the testing materials 2, 3, 4, and 5 obtained in Comparative Example were confirmed to be the martensitic steel in which the maximum stress was less than 1800 MPa and the desired strength cannot be achieved.

INDUSTRIAL APPLICABILITY

According to the martensitic steel of the present invention, it is possible to achieve the variation in the balance between the strength and the ductility in such a manner that the strength level is varied from 1800 MPa to 2160 MPa in TS (maximum stress) while the ductility is maintained at a certain level (total elongation: 13 to 15%), and thus the martensitic steel is suitable as non-tempered steel, for example, thick steel sheets, steel bars, or steel wires which are used in structures such as buildings and bridges, and automotive underbody, and mechanical parts such as gears. The non-tempered steel is a steel product to which the strength is granted by working effects of wire drawing, forging or the like without a heat treatment such as softening annealing treatment or quenching and tempering treatment. An example of the non-tempered steel product includes a product steel whose the reduction ratio of area from an initial cross section is 10% or more.

The method for producing the martensitic steel according to the present invention can control the structure based on low-C steel added with a steel composition of inexpensive Mn and Si using the existing rolling equipment provided in a normal steel mill without being a special annealing treatment without using expensive alloy elements such as Mo and Ni, and can produce high-strength steel having high in price competitiveness because the cost of capital investment is low.

The invention claimed is:

1. A martensitic steel having a microstructure of a martensite structure, containing a chemical composition, by mass %, of:

Si: 1.0 to 3.5%,

Mn: 4.5 to 5.5%,

Al: 0.001 to 0.080%,

Nb: 0.045% or less,

C in an amount satisfying the following regression equation (1), and a balance of Fe and inevitable impurities of:

P: 0.030% or less,

S: 0.020% or less, and

N: 0.010% or less, wherein the martensitic steel has a total elongation of 13 to 15%, and wherein the martensitic steel has a steel structure of a fine microstructure consisting of martensite having an average block grain size of 5.0 μm or less in a cross section in a direction vertical to a rolling direction, $$TS\ [\text{MPa}]=4000\times C[\text{mass }\%]+1050 \quad (1),$$

wherein TS is a maximum stress of the martensitic steel and is from 1800 to 2160 MPa.

2. A method for producing a martensitic steel of a material containing a chemical composition, by mass %, of:

Si: 1.0 to 3.5%,

Mn: 4.5 to 5.5%,

Al: 0.001 to 0.080%,

Nb: 0.045% or less,

C in an amount satisfying the following regression equation (1), and a balance of Fe and inevitable impurities of:

P: 0.030% or less,

S: 0.020% or less, and

N: 0.010% or less, $$TS\ [\text{MPa}]=4000\times C[\text{mass }\%]+1050 \quad (1),$$

wherein TS is a maximum stress of the martensitic steel, and is from 1800 to 2160 MPa;

the production method comprising:

uniformly heating the material at 1200° C.±25° C.; and air-cooling the heated material to a room temperature after being subjected to working with a reduction ratio of area of 84% or more by continuous forging in a temperature range of from 1200° C. to 750° C., thereby obtaining martensitic steel having a steel structure of a fine microstructure consisting of martensite having an average block grain size of 5.0 μm or less in a cross section in a direction vertical to a rolling direction.

* * * * *